US005954041A

United States Patent [19]

Sands

[11] Patent Number: 5,954,041

[45] Date of Patent: Sep. 21, 1999

[54] BOW CALIBRATING DEVICE

[76] Inventor: William L. Sands, 237 Carvel Rd., Pasadena, Md. 21122

[21] Appl. No.: 08/920,775

[22] Filed: Aug. 29, 1997

[51] Int. Cl.[6] ..... F41B 5/14

[52] U.S. Cl. ..... 124/1; 124/86

[58] Field of Search ..... 124/1, 23.1, 86; 73/161, 167

[56] References Cited

U.S. PATENT DOCUMENTS

| | | | |
|---|---|---|---|
| 2,763,156 | 9/1956 | Garigal | 124/23.1 X |
| 4,993,397 | 2/1991 | Cryar et al. | 124/23.1 |
| 5,121,736 | 6/1992 | Hawk | 124/86 |
| 5,222,473 | 6/1993 | Lint | 124/86 |
| 5,370,103 | 12/1994 | Desselle | 124/86 |
| 5,433,186 | 7/1995 | Corwin | 124/86 |

*Primary Examiner*—John A. Ricci

[57] ABSTRACT

The present invention relates to a device for calibrating an archery bow. More specifically, the present invention relates to a device wherein the draw of a bow can be calibrated against the movement of its limbs and pulleys. In its broadest context, the present invention includes a work surface to which both a winch, a bow securing means and first and second side measuring devices are secured. In use, the bow is drawn to its valley. Then through the use of the winch the tension in the cabling is released. In releasing the tension, measurements in the first and second side measuring devices are noted. In this manner the draw of the bow is calibrated against movement of the bow's limbs and pulleys.

5 Claims, 3 Drawing Sheets

BOW CALIBRATING DEVICE

BACKGROUND OF THE INVENTION

1. Field of the Invention

The present invention relates to a calibrating device for a bow and more particularly pertains to a device which allows a user to synchronize the draw and pulley movements.

2. Description of the Prior Art

The use of a bow tuning devices is known in the prior art. More specifically, bow tuning devices are known to consist basically of familiar, expected and obvious structural configurations, notwithstanding the myriad of designs encompassed by the crowded prior art which have been developed for the fulfillment of countless objectives and requirements.

By way of background U.S. Pat. No. 5,121,736 to Hawk discloses an archery bow sighting tuning apparatus. U.S. Pat. No. 5,222,473 to Lint discloses a bow press apparatus. U.S. Pat. No. 4,993,397 to Cryar et al. discloses an apparatus for calibrating an archery bow. U.S. Pat. No. 5,175,937 to Emerson, III discloses a bow tuning gauge. Lastly, U.S. Pat. No. 5,240,211 to Anderson discloses a bow support apparatus; and U.S. Design Pat. No. 243,320 to MacWilliams discloses an archery bow weight scale.

In this respect, the bow calibrating devices substantially departs from the conventional concepts and designs of the prior art, and in so doing provides an apparatus primarily developed for the purpose of coordinating the bow draw and pulley movements.

Therefore, it can be appreciated that there exists a continuing need for improving the accuracy of bows. In this regard, the present invention substantially fulfills this need.

SUMMARY OF THE INVENTION

In view of the foregoing disadvantages inherent in the known types of bow tuning devices now present in the prior art, the present invention provides an easy means to set a bow to its factory specifications. As such, the general purpose of the present invention, which will be described subsequently in greater detail, is to enable a user to calibrate a bow's draw to its pulley and limb movements.

To attain this, the present invention essentially comprises a device for calibrating an archery bow. More specifically, the present invention relates to a device wherein the draw of a bow can be calibrated against the movement of its limbs and pulleys. In its broadest context, the present invention includes a work surface to which both a winch, a bow securing means and first and second side measuring devices are secured. In use, the bow is drawn to its valley. Then through the use of the winch the tension in the cabling is released. In releasing the tension, measurements in the first and second side measuring devices are noted. In this manner the draw of the bow is calibrated against movement of the bow's limbs and pulleys.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved bow tuning device for calibrating the movements of the limbs and cams of a bow to its draw. The device comprises a T-shaped work surface having an top surface, a bottom surface, a first side, a second side, a rearward extent, a forward extent and an intermediate length therebetween. A winch is secured to the rearward extent of the work surface, the winch has a length of cable secured thereto, a force measuring device is secured along the length of the cable, with the force measuring device adapted to measure the amount of force applied to the cable. A linear scale is positioned along the intermediate length of the work surface for measuring the length of the bow's draw. A bow securing means is employed which includes a plurality of interconnected bow presses, and a roller cushion secured upon at least two of the bow presses. The plurality of interconnected bow presses are adapted for movement long the length of the work surface. A hydraulic jack is interconnected to both the plurality of bow presses and the bottom of the work surface. The hydraulic jack functions to oppose the forward movement of the limbs of the bow positioned within the device. Additionally, a handle is secured to the forward extent of the work surface and is adapted to oppose the forward movement of the bow. A first side measuring device is included in the device. The measuring device has a contact surface interconnected to the top of the work surface by way of two springs, a scale is positioned adjacent the first side measuring device for measuring the linear deflection of the contact surface. The contact surface is adapted to engage one of the cams of the bow, with the contact surface being coated with Teflon. Likewise, a second side measuring device is included with a contact surface interconnected to the top of the work surface by way of two springs. A scale is positioned adjacent the second side measuring device for measuring the linear deflection of the contact surface, the contact surface is adapted to engage one of the cams of the bow, with the contact surface being coated with Teflon.

It is another object of the present invention to provide a device which can operate as a timing machine, bow press or a force draw machine.

It is a further object of the present invention to provide a device which allows a shooter to set a bow to his/her individual preference.

An even further object of the present invention is to provide a calibrating device which is susceptible of a low cost of manufacture with regard to both materials and labor, and which accordingly is then susceptible of low prices of sale to the consuming public, thereby making such bow calibrating device economically available to the buying public.

Still yet another object of the present invention is to provide a bow calibrating device which provides in the apparatuses and methods of the prior art some of the advantages thereof, while simultaneously overcoming some of the disadvantages normally associated therewith.

Still another object of the present invention is to provide a bow calibrating device which readily accepts any size bow.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
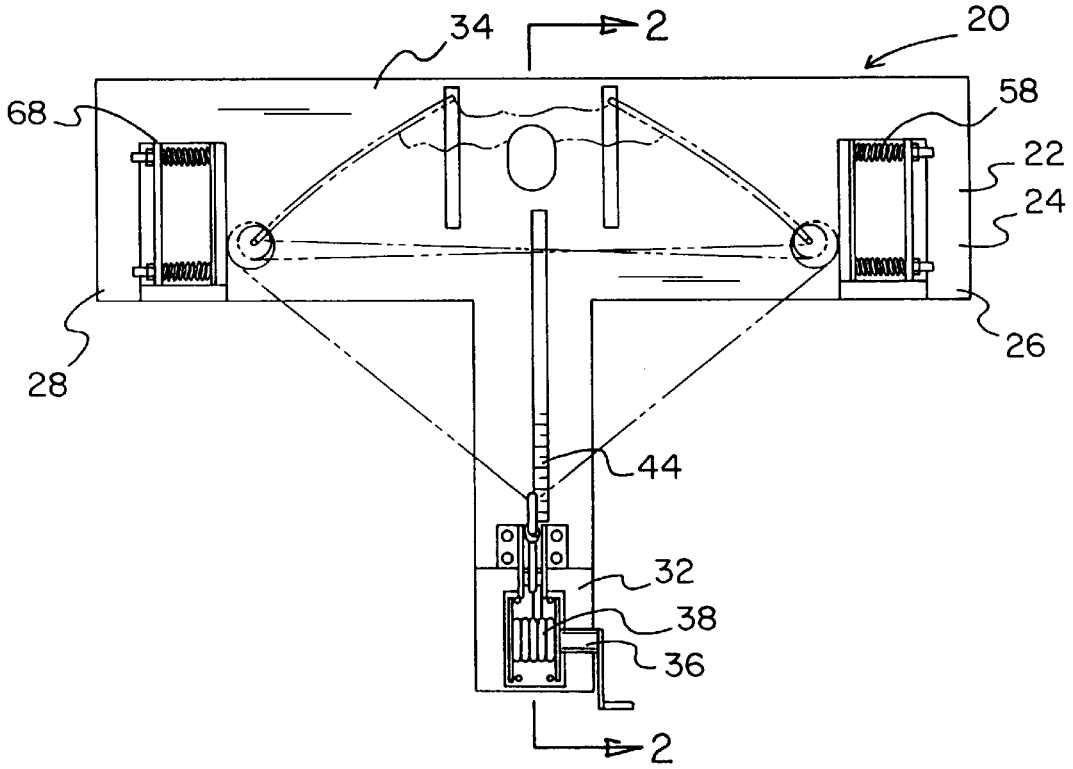
FIG. 1 is a plan view of the bow calibrating device of the present invention.

The present invention relates to a device 20 for calibrating an archery bow. More specifically, the present invention relates to a device wherein the draw of a bow can be calibrated against the movement of its limbs and pulleys. In its broadest context, the present invention includes a work surface to which both a winch, a bow securing means and first and second side measuring devices are secured. In use, the bow is drawn to its valley. Then through the use of the winch the tension in the cabling is released. In releasing the tension, measurements in the first and second side measuring devices are noted. In this manner the draw of the bow is calibrated against movement of the bow's limbs and pulleys. The various details of the present invention, and the manner in which they interrelate, will be described in greater detail hereinafter.

The T-shaped work surface 22 is defined by a top surface 24, a bottom surface, a first side 26, a second side 28, a rearward extent 32, a forward extent 34 and an intermediate length therebetween. The work surface 22 is illustrated in reference to FIG. 1. The work surface 22 supports both the calibrating equipment and the bow to be calibrated.

Figure 2:
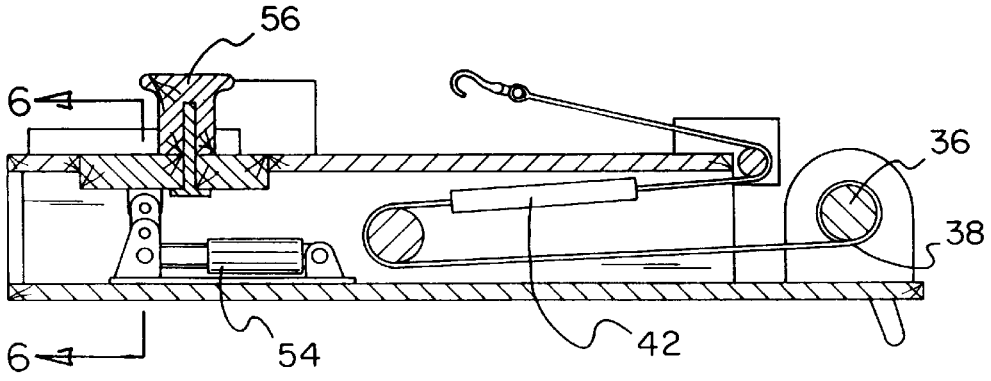
FIG. 2 is a view taken along line 2—2 of FIG. 1.

A winch 36 is secured to the rearward extent 32 of the work surface 22. The winch 36 includes a length of cable 38 secured thereto. With reference to FIG. 2, the length of cable 38 can be threaded around two or more pulleys to enable connecting the cable 38 to the cabling of the bow 30. In the preferred embodiment, a force measuring device 42 is secured along the length of the cable 38. The force measuring 42 device measures the amount of force applied to the cable 38. Additionally, as depicted in FIG. 1, a linear scale 44 is positioned along the intermediate length of the work surface 22 for measuring the length of the bow's draw. Through the scale 44 and measuring device 42, both the linear extent of the draw and the force applied to the bow's cabling can be determined.

Figure 3:
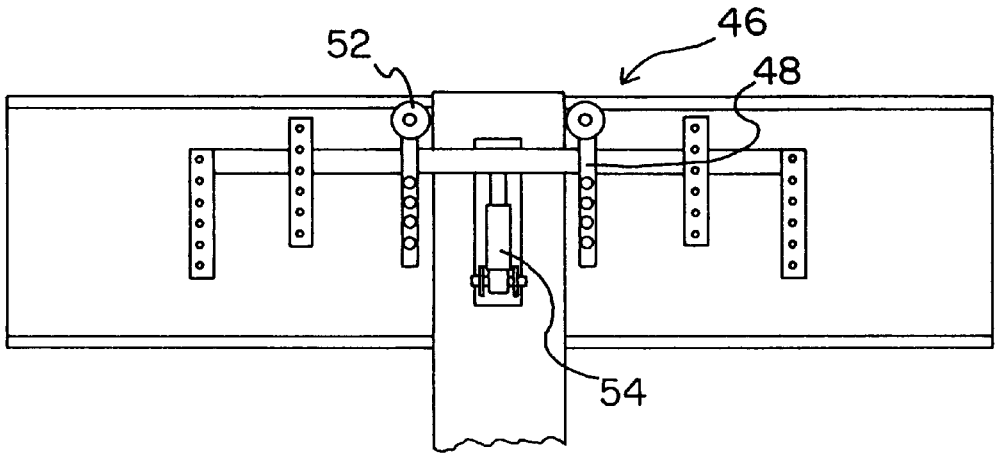
FIG. 3 is a view of the bow securing means of the present invention.
Figure 4:
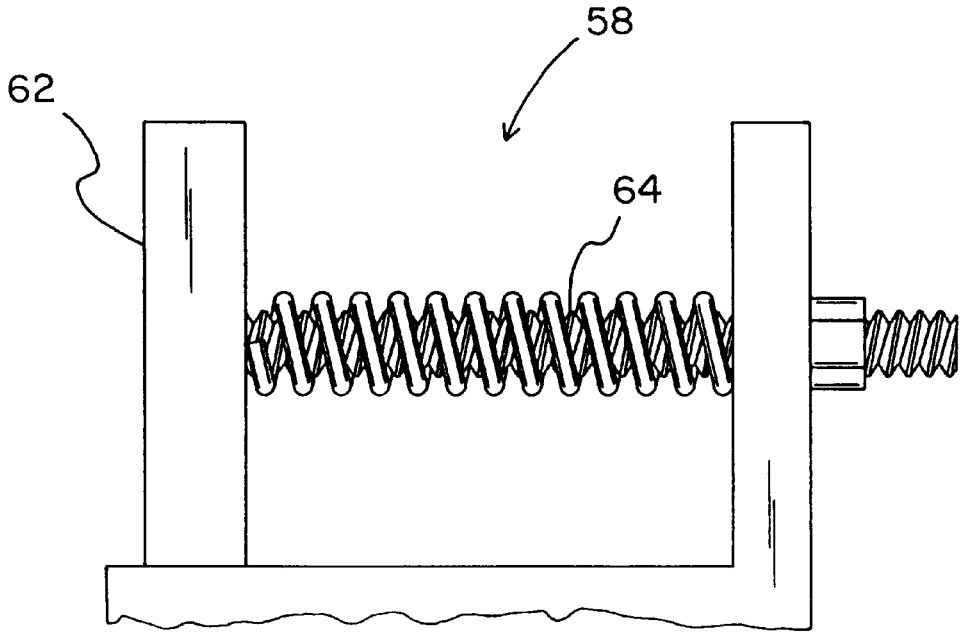
FIG. 4 is a view of one of the springs employed in one of the side measuring devices of the present invention.
Figure 5:
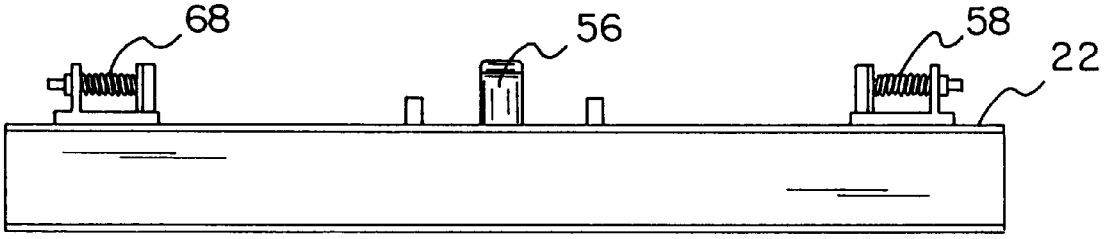
FIG. 5 is front elevational view of the bow calibrating device.
Figure 6:
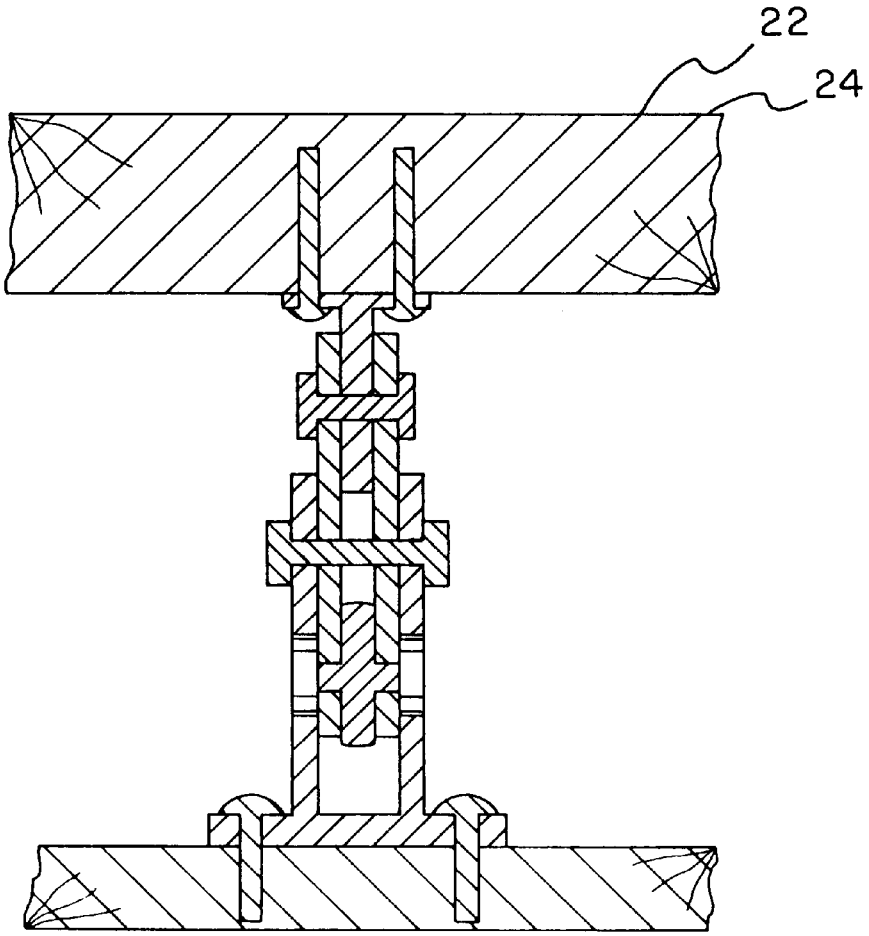
FIG. 6 is a view taken along line 6—6 of FIG. 2.

Any bow 30 can be secured to the top 24 of the work surface 22 by way of the securing means 46. The bow securing means 46 includes a plurality of interconnected bow presses 48. A roller cushion 52 is secured upon at least two of the bow presses 48. The bow presses 48 and rollers 52 are omitted from FIG. 1 for clarity. The presses 48 and rollers 52, however, are depicted in FIG. 3. The plurality of interconnected bow presses 48 are adapted for movement long the length of the work surface 22. A hydraulic jack 54 is interconnected to both the plurality of bow presses 48 and the bottom of the work surface 22. The hydraulic jack 54 functions to oppose the forward movement of the limbs of a bow 30 positioned within the device 20. Additionally, a handle 56 is secured to the forward extent 34 of the work surface 22 and adapted to oppose the forward movement of the bow 30.

The first side measuring device 58 includes a contact surface 62 interconnected to the top 24 of the work surface 22 by way of two springs 64. Additionally, a scale is positioned adjacent the first side measuring device 58 for measuring the linear deflection of the contact surface 62. The contact surface 62 is adapted to engage one of the cams of the bow 30 with the bow secured within the device 20. In the preferred embodiment, the contact surface 62 is coated with Teflon.

Similarly, the second side measuring device 68 includes a contact surface interconnected to the top 24 of the work surface 22 by way of two springs. A scale is positioned adjacent the second side measuring device 68 for measuring the linear deflection of the contact surface 72. The contact surface 72 is adapted to engage one of the cams of the bow 30. In the preferred embodiment, the contact surface 72 is coated with Teflon.

In use, a bow is placed within the device. More specifically, the bow presses are placed against the outer surface of the bow limbs, and the handle is secured against the centermost portion of the bow. Next, the winch is secured to the bow's cabling and the cabling is drawn to its valley. At this stage, measurements are taken of the length of the draw and the force in the cabling. Additionally, the measurements on the first and second side measuring devices are taken. Lastly, the tension in the bow is released in measured amounts by way of the winch. The released tension is then measured against the movements of the first and second side measuring devices.

The ultra bow tuning machine is a specially designed machine to tune the cams on a two wheel or two cam bow. The machine consists of a winch at one end of a T-shaped units with cam deflection measurements devices at each side (at the top and bottom cam position, bow laying flat) a hydraulic bow press is built into the body of the T shaped frame work also there is a weight scale for measuring the draw poundage of the bow. the poundage scale is also used in conjunction with the deflecting devices to locate the precise valley of the bow during the draw cycle. The main T shape frame of the unit can be produced out of clear plastic with an incremented scale etched on the top surface to measure the draw length of the bow.

To use the ultra bow tuning machine, the bow is placed on the machine, as the bow is drawn the scale weight will build to the point where the weight will suddenly decrease, this is the valley. Drawing the bow past this point will result in an increase in poundage, this is known as the wall. These numbers both poundage and location of the valley are documented in a chart form. Upon releasing the bow it will return to its valley position. Placing the cam deflection devices at the top and bottom cams, the measurement is taken as the zero reading. Releasing the tension in the bow in measured amounted by way of the winch and simultaneously recording the deflections devices will result in the calibrating or synchronization of the bow.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A bow tuning device for calibrating the movements of the limbs and cams of a bow to its draw, the device comprising in combination:

a T-shaped work surface having an top surface, a bottom surface, a first side, a second side, a rearward extent, a forward extent and an intermediate length therebetween;

a winch secured to the rearward extent of the work surface, the winch having a length of cable secured thereto, a free end of the cable securing to a cable of a bow, a force measuring device secured along the length of the cable, the force measuring device adapted to measure the amount of force applied to the cable, a linear scale positioned along the intermediate length of the work surface for measuring the length of the bow's draw;

a bow securing means, the means including a plurality of interconnected bow presses, a roller cushion secured upon at least two of the bow presses, the plurality of interconnected bow presses adapted for movement along the length of the work surface, a hydraulic jack interconnected to both the plurality of bow presses and the bottom of the work surface, the hydraulic jack functioning to oppose the forward movement of the limbs of the bow positioned within the device, a handle secured to the forward extent of the work surface and adapted to oppose the forward movement of the bow;

a first side measuring device including a contact surface interconnected to the top of the work surface by way of two springs, the contact surface adapted to engage one of the cams of the bow, the contact surface being coated with a non-stick material;

a second side measuring device including a contact surface interconnected to the top of the work surface by way of two springs, the contact surface adapted to engage one of the cams of the bow, the contact surface being coated with a non-stick material.

2. A bow tuning device for calibrating the movements of the limbs and cams of a bow to its draw, the device comprising in combination:

a T-shaped work surface having an top surface, a bottom surface, a first side, a second side, a rearward extent, a forward extent and an intermediate length therebetween;

a winch secured to the rearward extent of the work surface, the winch having a length of cable secured thereto, a free end of the cable securing to a cable of a bow, a force measuring device secured along the length of the cable, the force measuring device adapted to measure the amount of force applied to the cable, a linear scale positioned along the intermediate length of the work surface for measuring the length of the bow's draw;

a bow securing means, the means including a plurality of interconnected bow presses, a roller cushion secured upon at least two of the bow presses, the plurality of interconnected bow presses adapted for movement along the length of the work surface;

a first side measuring device including a contact surface interconnected to the top of the work surface, the contact surface adapted to engage one of the cams of the bow;

a second side measuring device including a contact surface interconnected to the top of the work surface, the contact surface adapted to engage one of the cams of the bow.

3. The bow calibrating device as described in claim 2 further comprising:

a hydraulic jack interconnected to both the plurality of bow presses and the bottom of the work surface, the hydraulic jack functioning to oppose the forward movement of the limbs of the bow positioned within the device.

4. The bow calibrating device as described in claim 2 further comprising:

a handle secured to the forward extent of the work surface and adapted to oppose the forward movement of the bow.

5. The bow calibrating device as described in claim 2 wherein:

each of the contact surfaces is coated with a non-stick material.

* * * * *